United States Patent [19]

Schönenberger

[11] 4,334,676

[45] Jun. 15, 1982

[54] MOVABLE SURFACE APPARATUS, PARTICULARLY FOR PHYSICAL EXERCISE AND TRAINING

[75] Inventor: Rolf Schönenberger, Zurich, Switzerland

[73] Assignee: Wilhelm Schonenberger, Pratteln, Switzerland

[21] Appl. No.: 926,149

[22] Filed: Jul. 19, 1978

Related U.S. Application Data

[63] Continuation-in-part of Ser. No. 616,951, Sep. 26, 1975, abandoned.

[30] Foreign Application Priority Data

| | | | |
|---|---|---|---|
| Oct. 11, 1974 | [CH] | Switzerland | 13691/74 |
| Oct. 23, 1974 | [CH] | Switzerland | 14169/74 |
| Sep. 23, 1977 | [CH] | Switzerland | 11880/77 |

[51] Int. Cl.[3] ..... A63B 23/06

[52] U.S. Cl. ..... 272/69

[58] Field of Search ..... 272/69, 97, 3, 4, 9, 272/11, 12, 16; 198/842, 843, 844, 793, 833, 837, 841, 851, 822

[56] References Cited

U.S. PATENT DOCUMENTS

| | | | |
|---|---|---|---|
| 780,145 | 1/1905 | Vaughan | 198/833 X |
| 1,016,729 | 2/1912 | Barrett | 272/69 |
| 1,364,699 | 1/1921 | Brown | 272/69 |
| 2,017,885 | 10/1935 | Atcheson | 272/69 |
| 2,329,687 | 9/1943 | Becker | 198/851 |
| 2,863,555 | 12/1958 | Jaritz | 198/833 |
| 3,047,291 | 7/1962 | Hall | 272/69 X |
| 3,408,067 | 10/1968 | Armstrong | 272/16 |
| 3,669,238 | 6/1972 | Folkes et al. | 198/837 X |
| 3,711,090 | 1/1973 | Fiedler | 272/69 |
| 3,941,377 | 3/1976 | Lie | 272/97 |
| 3,952,861 | 4/1976 | Holmquist et al. | 198/842 |
| 3,961,751 | 6/1976 | Kessler | 272/56.5 SS X |
| 3,976,192 | 8/1976 | Müller | 198/844 X |

FOREIGN PATENT DOCUMENTS

| | | | |
|---|---|---|---|
| 592657 | 1/1934 | Fed. Rep. of Germany | 198/844 |
| 1174254 | 7/1964 | Fed. Rep. of Germany | 198/822 |
| 2109203 | 9/1972 | Fed. Rep. of Germany | 272/97 |
| 419513 | 3/1947 | Italy | 272/69 |
| 191377 | 6/1937 | Switzerland | 198/844 |
| 168159 | 3/1965 | U.S.S.R. | 272/69 |

*Primary Examiner*—Richard J. Apley
*Assistant Examiner*—Arnold W. Kramer
*Attorney, Agent, or Firm*—Frishauf, Holtz, Goodman & Woodward

[57] ABSTRACT

An elongated frame retains a pair of drums, sheaves, pulleys or the like, at the ends of the frame, one of which is preferably power driven; the movable surface includes a plurality of step elements which have a flat top surface, preferably covered with a resilient surfacing, such as foam rubber, carpeting, or the like, to form an endless flexible belt which may be a composite of an endless belting to which slats are secured. The slat elements span the width of the apparatus and, in cross section, preferably have T-shape. A series of back-up support rollers with lateral guide flanges are located beneath the upper run of the movable support surface, with at least one elastic cushion support between the rollers and the slats, for example formed of an endless rubber V-belt in contact with the lateral flanges of the support rollers to accept lateral forces arising in use.

22 Claims, 24 Drawing Figures

Fig. 2
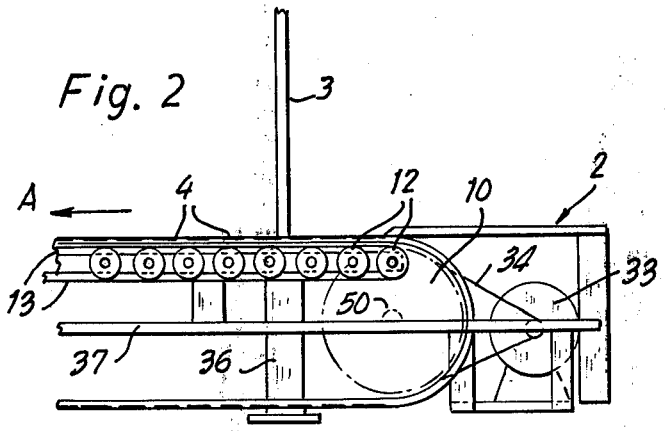
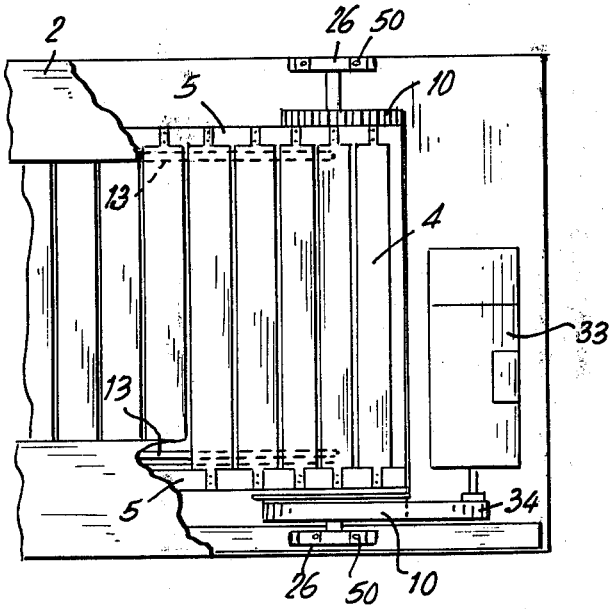
Fig. 3

FIG.11
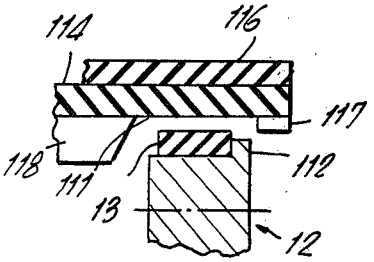
FIG.12
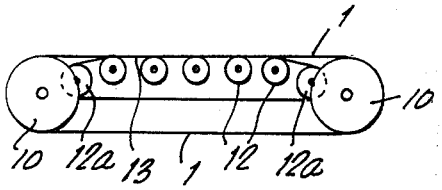
FIG. 13
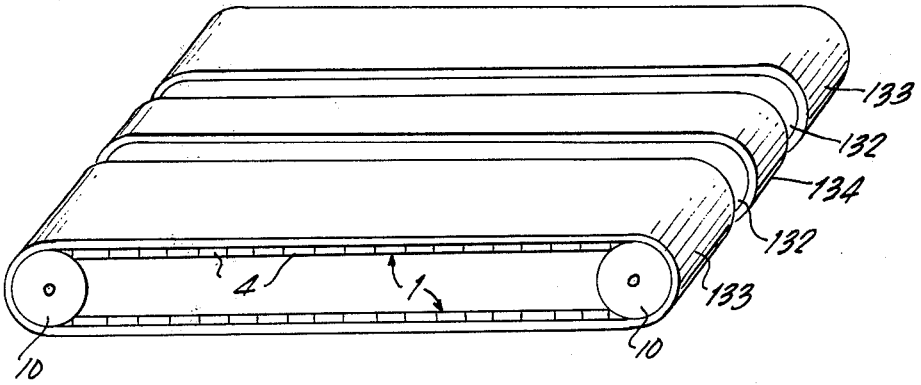
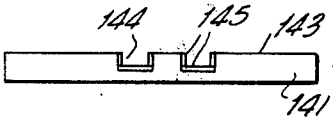
FIG.14
FIG.15
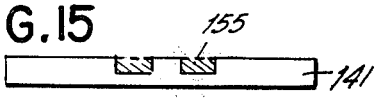
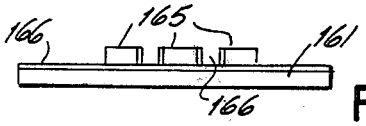
FIG.16
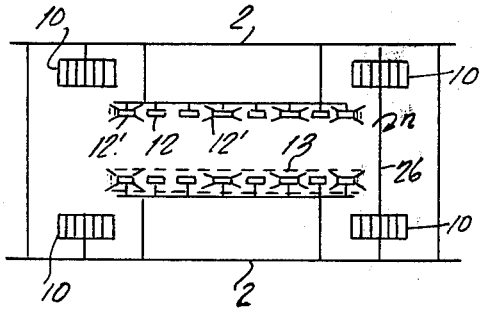
FIG. 19
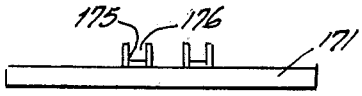
FIG.17
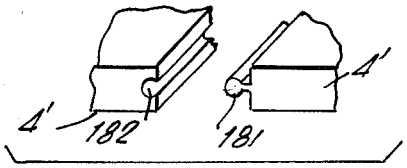
FIG.18

MOVABLE SURFACE APPARATUS, PARTICULARLY FOR PHYSICAL EXERCISE AND TRAINING

This application is a continuation-in-part of my prior application U.S. Ser. No. 616,951, filed Sept. 26, 1975, abandoned.

Reference to related literature:

U.S. Pat. No. 3,711,090, Fiedler;

U.S. Pat. No. 3,731,917, Townsend;

U.S. Pat. No. 1,016,729, Barrett;

U.S. Pat. No. 4,026,545, Schonenberger.

The present invention relates to a movable surface apparatus, and more particularly to such an apparatus specifically useful for physical exercise and training, for ergonmetry and walking therapy for handicapped people.

BACKGROUND AND PRIOR ART

Various types of movable surface apparatus have been proposed. Such apparatus, often referred to as "treadmills," are suitable for physical exercise and training in sports and physical conditioning; and for physical rehabilitation after accident or disease have stricken a user. Such apparatus usually includes an endless belt or the like, which may be a wide rubber belt supported throughout its width by a stationary support so that the rubber belt will not bow or bend through due to the weight of the user. As the movable rubber band engages a back-up support surface, substantial friction between the rubber band and the support surface arises, requiring substantial drive power. The rubber band is subject to wear due to friction between it and the support. The feel of the step on the rubber band is disagreeable since it is hard, because the thickness of the rubber band is limited to restrict the drive power to reasonable levels.

Various types of construction for the surface itself have been proposed, and roller supports have previously been disclosed, see, for example, U.S. Pat. No. 1,016,729, Barrett, of February 6, 1912. Difficulties arise in use when placing roller supports beneath a rubber or fabric blanket, particularly if reinforced, since the drive power to move a heavy blanket which does not transmit the "feel" of the rollers to the user requires considerable drive power while, additionally, the noise level of such apparatus is high. It has also been proposed to utilize chain drives in which the rubber belt or blanket itself is driven and pulled by chains. Again, the drive power is considerable and the noise level is high. In addition lateral forces of the leg of the runner causes belt guiding problems with a high risk of accident. Two guide systems are necessary: a continuous adjustment of the movable surface about the rotable elements in a manner, wherein the position of the step slats is exactly right-angled with regard to the running direction. This is guaranteed by ribs, either attached to the step slats or preferably to the drive belt like a teeth belt. The ribs correspond to the ribber circumference of the driving elements and forces the movable surface into the right position preventing lateral movement and dangerous lock. Another guiding system is located beneath the runner to prevent lateral movement of the movable surface in this area.

THE INVENTION

It is an object of the present invention to provide a movable surface apparatus, typically for physical exercise and training, which is safe in operation and requires little operating power, has low noise level in operation and provides a pleasant, springy feel when being stepped or jumped on without, however, being excessively stressed by bending or bowing, so that the surface which is engaged by the foot of the user will have, essentially, the characteristics of a yielding, yet firm support similar, for example, to walking on moss-covered ground or a needle-covered path.

Briefly, in accordance with the present invention, an elongated support frame has rotatable driving elements, such as drums, sheaves, pulleys or the like at either end, around which the movable surface is looped. At least one of these driving elements has a toothed or ribbed circumference. The movable surface includes a plurality of step slat elements, preferably in the form of separate slats preferably covered with a compact, continuous endless or sectionalized resilient surfacing such as foam rubber, carpeting, and the like. If separate slats are provided, they are preferably secured at their ends to a belting which is ribbed, engaging the toothed sprocket or rotatable element to be driven thereby. Internally of the runs of the endless surface, as it is looped about the end drums or sheaves, the slat elements are preferably formed with a stiffening projection, in form of transverse ribs, to prevent their bowing through. Longitudinally, between the back- and front-driving elements, the surface is supported nearly along the full length of its upper run by series of back-up support rollers. These support rollers are formed with lateral flanges; for example, they may be in the form of a V-belt pulleys, and have at least one separate V-belt which is looped about the end support rollers and which is preferably spaced from the inner surface of the upper run of the endless movable surface, when unloaded, by a distance of for example about ½ cm in the area of the support rollers to prevent noise, which is otherwise caused by hits of the step slats after coming from the vertical position into the horizontal. When loaded, that is, when a user steps on the movable surface, the lower side of the V-belt will engage the rollers. The rollers and the interposed belt—if used—are located at the lateral edges of the movable surface and provide not only for support of the movable surface along its length, but also for lateral guidance due to lateral forces which will invariably arise when the surface is used as an exercise device, for example, for running, training for cross-country skiing, physical rehabilitation after injury or disease, or the like. The flanges of the rollers or the V-sides thus provide lateral guidance throughout the length of the movable support surface when used. The V-belt is not looped about the end drums, pulleys or sheaves and therefore not stressed, so that the amount of drive power is minimized. The upper side of the V-belt is also made by soft flexible and anti-sliding material, which prevents a slide or lateral movements of the step slats or supported walking surface. The resilient, elastic material of the V-belt is a relatively soft and the engagement of which with a hard surface, such as metal rollers, will permit silent operation.

The construction substantially reduces friction and wear on the movable surface and permits operation with security and low power, while operating at low noise levels. It provides a pleasant feel when being stepped upon by slightly resiliently yielding without, however, bowing through or bending in the middle.

Drawings, illustrating preferred examples:

FIG. 2 is a fragmentary schematic side view of the movable surface and its drive arrangement, with the housing removed;

FIG. 3 is a fragmentary top view of the movable surface apparatus with part of the housing broken away; at the lower part, one of the slats is also broken away to show the support belt therebeneath;

Figure 10:
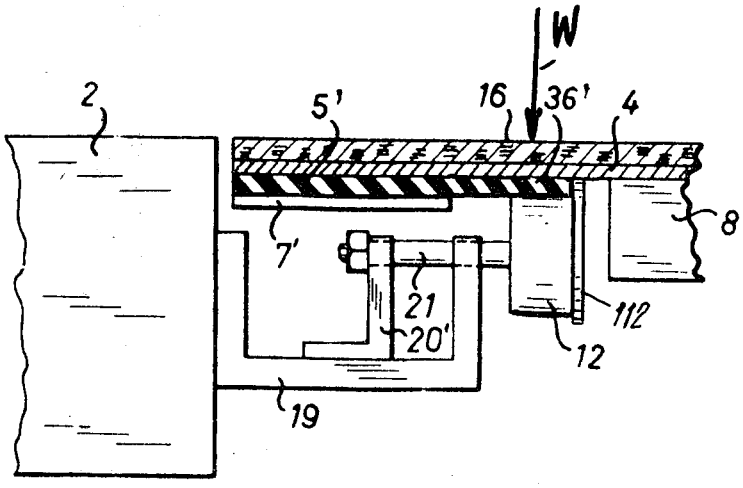
FIG. 10 is a fragmentary, part sectional view of another embodiment.
Figure 10A:
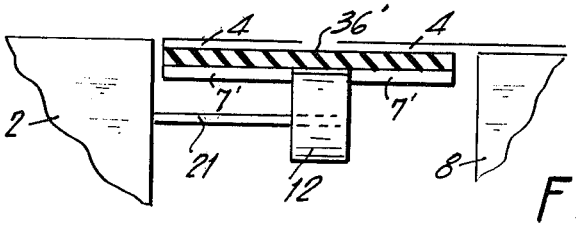
Figure 20:
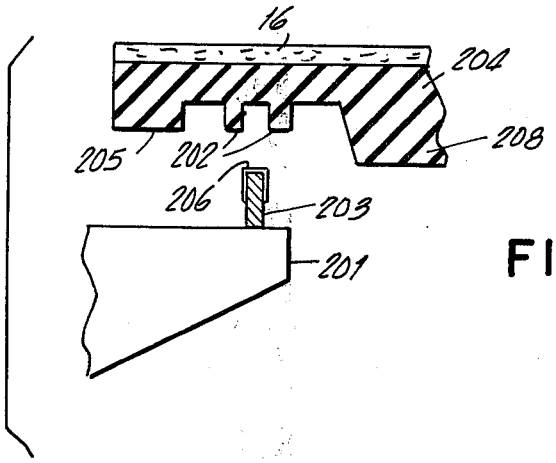
Figure 21:
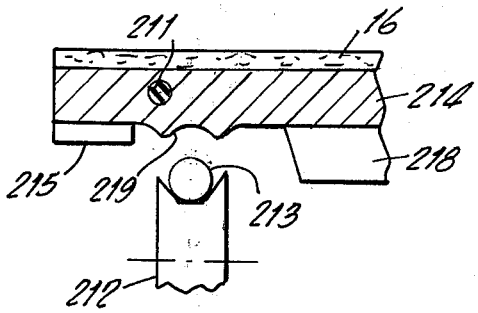
Figure 22:
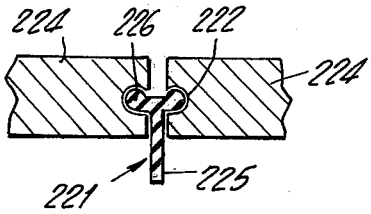
Figure 23:
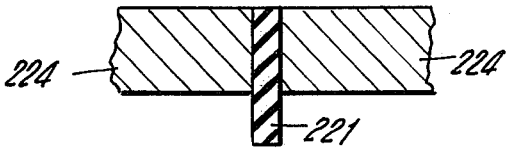

FIG. 10*a* is a fragmentary part sectional view of another embodiment showing support of slats with lateral guidance effects by the structure of the supporting and cushioning belt;

FIG. 11 is a fragmentary cross-sectional view showing another guiding and support arrangement for the movable support surface, in section;

FIG. 12 is a highly schematic representation of the arrangement of the support to provide a soft, resilient step-on feel;

FIG. 13 is a schematic representation of a movable support surface, particularly suitable for training for cross-country skiing;

FIG. 14 is a schematic transverse sectional view through the support surface of FIG. 13;

FIG. 15 is a view similar to FIG. 14 and showing an addition to make the surface universally applicable for physical exercise and training;

FIG. 16 is a transverse schematic view illustrating another modification of the support surface to adapt the apparatus for training for cross-country skiing;

FIG. 17 is a transverse schematic view showing yet another embodiment of the support surface suitable for training for cross-country skiing;

FIG. 18 is a fragmentary schematic illustration of a coupling arrangement for two lamellae, showing two adjacent lamellae in exploded view; and FIG. 19 is a highly schematic top view of the support and drive arrangement for the running surface, with the running surface itself removed, and also illustrating another modification;

FIG. 20 is a fragmentary sectional view through a step slat and showing another guiding and support arrangement, in which the separation between the step slat and the guiding and support means is grealy exaggerated;

FIG. 21 is a fragmentary cross-sectional view through a step slat showing yet another embodiment of a support arrangement;

FIG. 22 is a longitudinal cross-sectional view through a pair of adjacent step slats which are connected by a separatable connecting element forming, additionally, a transport projection; and FIG. 23 illustrates another arrangement of attachment of adjacent slats to form a continuous belt.

Figure 1:
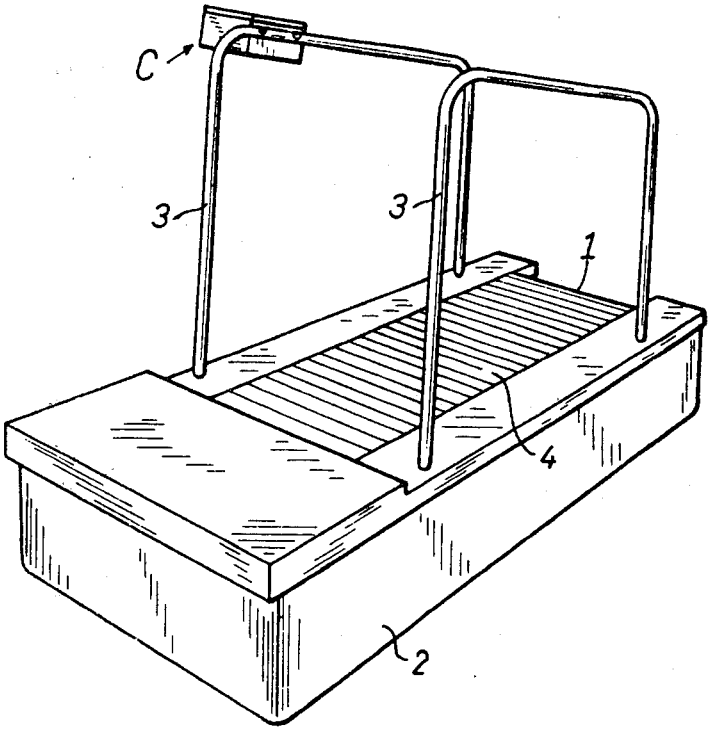
FIG. 1 is a general perspective view of the apparatus arranged for training and physical exercise.

The physical exercise apparatus illustrated in FIG. 1 is driven by a motor 33 (FIGS. 2, 3) which drives the movable surface 1. A person standing on the surface, when driven, in order to remain thereon, must walk, jog, or run. The apparatus is enclosed in a housing 2 to which also support bars 3 are secured. A control unit C is mounted on one of the support bars to control operation of the motor, for example its starting, stopping, and operating speed.

Figure 4:
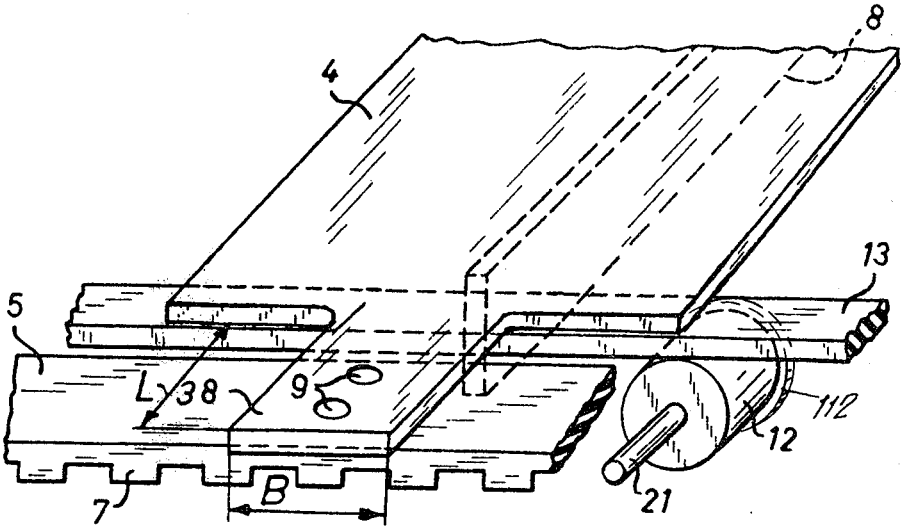
FIG. 4 is a fragmentary perspective view of the attachment arrangement of slats to the drive belt.

The housing 2 includes frame members 36, 37 (FIG. 2) which provide for physical and structural support. The frame members 36, 37 are only shown schematically. The may have any suitable structure or profile. At either end of the apparatus (see FIGS. 3 and 12), and within the housing 2 are located rotatable drums, rollers, sheaves, sprockets, or the like, about which the surface 1, which is an endless loop, is placed. The rotatable elements, preferably in the form of two operating drums or rollers 10, are suitably journalled in the frame as seen at 50, FIG. 3. If two sheaves or pulleys ar provided at either end of the apparatus, one will be located at either side thereof, suitably journalled and, preferably, connected by a transverse shaft 26 (FIG. 19). The rollers or sheaves 10 have a toothed or ribbed circumference. Two endless gear belts 5 (FIGS. 3, 4), one each located at a respective side of the apparatus, and both having internally projecting teeth 7 (FIG. 4), are engaged with the circumference of the ribbed or toothed rollers 10, thus ensuring slipless, positive common drive of both of the toothed belts 5 in the operating direction and preventing lateral dislocation of the endless loop as shown by Arrow A in FIG. 2. The toothed belts 5 are flexible and are made of rubber, or suitable flexible plastic material. One of the drums 10 is driven by motor 33, or by gravity of earth or by any other suitable motive drive apparatus by means of a drive belt 34 (FIGS. 2, 3), preferably with interposition of a step-down gearing. The motor is controlled by controller C (FIG. 1). The toothed belts 5 (FIG. 4) have a group of step slats 4 secured thereto by means of rivets 9, so that the belts connect the slats 4 to form the endless surface 1. The rivets 9 are positioned over the teeth 7 of the belts 5 (FIG. 4). The slats 4 are preferably of lightweight metal, for example of aluminum, and extend transversly to the running direction indicated by arrow A of the movable surface. The slats 4 have generally T-shaped cross section and have a center web 8. The center web 8 is recessed at the end portions of the slats. The ends of the slats, in the region of connection of the slats 4 to the belts 5, have reduced width with respect to the width of the slats 4 intermediate of their length, to form an essentially rectangular tongue 38 (FIG. 4) having a width B and a length L. The width B is less than the width of the slats 4. The distance between adjacent steps slats 4 is so selected that only little prevent interference of adjacent slats upon movement. The upper surface of the slats 4 is covered with an impact-reducing cover 16 (FIGS. 5, 6, 7; omitted from FIG. 4 for clarity) to provide for soft initial engagement when stepping on the surface and to provide a pleasant yielding top surface and to reduce stress on joints and ligaments. The material for cover 16 may be rubber, cork, dense sponge rubber, plastic foam, artificial lawn surfacing, indoor/outdoor carpeting, particularly with rubber backing, or the like.

Figure 7:
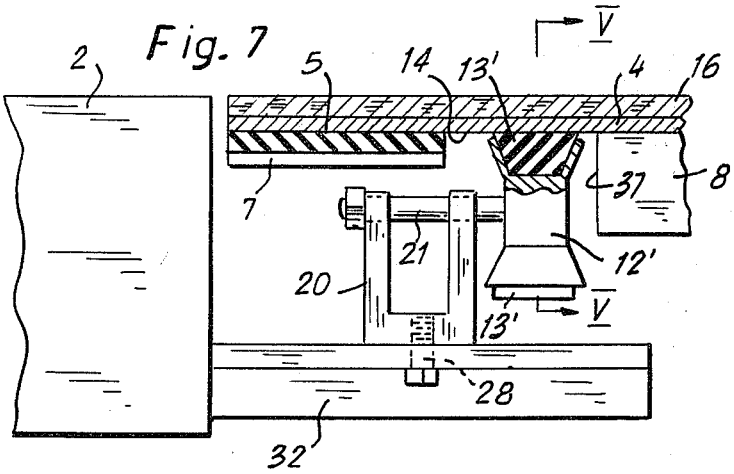
FIG. 7 is a transverse cross-sectional view illustrating a V-belt support.

Support rollers 12 are provided to prevent bending-through of the belts 5 upon loading of the steps by a person. A support belt 13 is positioned between the upper sides of the support rollers 12 and the lower side of the slats 4. The slats 4, therefore, are supported at their marginal ends by the support rollers 12 with the support belt 13 interposed. Except for the motor 33 and the drive belt 34 thereof, the apparatus is essentially symmetrical with respect to its longitudinal extent and, therefore, the system of belt 5, rollers 12 and support belt 13 is duplicated at the other side. The support belts 13, one at each side, are made of rubber, or other suitable elastic material and may, for example, be a flat belt (FIGS. 4, 8, 11) or be a V-belt (FIG. 7). Each one of the belts 13, 13' is supported by a group of the adjacently located support rollers. The belt 13 are preferably 10–15 mm thick and absorb the steps like a soft soil in a wood. They also eliminate all vibrations caused by the rollers, which gives a guiet, soft and homogeneous running feeling. The structures of the contact surfaces between the belts 13 and the movable surface exclude any lateral movements of the movable surface by slipping or gliding. The support rollers are formed with lateral flanges 112 (FIGS. 4, 8, 11) to provide for lateral guidance of the belt 13. Flanges 112 may be located at either or, both end faces of the support rollers, as seen, respectively, in FIGS. 4, 8 and 11. If the belt is a V-belt as seen at 13', FIG. 7, then the roller is shaped to fit—see roller 12', FIG. 7. The rollers support the upper run of the movable surface 1, with the cushioned support belt 13 interposed, and are present throughout at least the entire useful length of the support surface. The diameter of the rollers 12 is less than the diameter of the drums or rollers 10. The good lateral guidance of the support belt 13 is obtained by the projecting shoulders or flanges 112 of the support rollers, or of the V-groove (FIG. 7).

Figure 5:
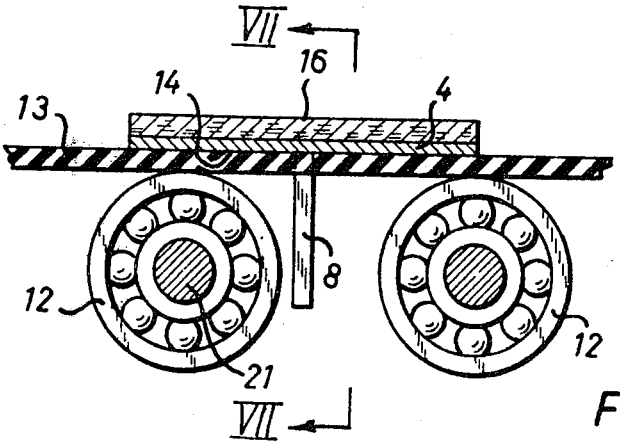
FIG. 5 is a fragmentary vertical sectional view through the surface in the region of the support belt.

The support rollers 12, 12' are journalled to rotate about screws or bolts 21 (FIG. 5). The bolts 21 are held in U-channels 20 (FIG. 7). The U-channels 20 are carried, in turn, by transversely located angle irons, T-rails, or channel rails, or other suitable structural members, seen generally at 32 (FIG. 7) and supported, for example, on, or forming part of the frame members 36, 37 (FIG. 2), or otherwise suitably secured to the frame members and housing 2 of the apparatus. The connection between the U-channels 20 and the rails 32, preferably, is by screws 28, although any other suitable connection may be used such as welding. The support rollers 12, 12' are journalled by means of low-friction bearings, for example needle bearings or ball bearings (FIG. 5) although sleeve bearings operating with low friction with respect to bolt 21 may also be used. The spacing between the upper surface of the support belt 13 and the lower surface 14 of the step slats 4 is so selected in the area, where the U-belt 13' (FIG. 7) or support belt 13 (FIG. 5) is positioned over the support rollers 12 that a small distance in the order of, for example, about ½ cm, preferably, is left when the surface 1 is unloaded. Upon loading, for example by the user stepping on the slats 4, the flat underside 14 of the respective slat 4 will engage the support belt 13, 13'. Support belt 13, 13' is carried along in the direction of the arrow A (FIG. 2) when engaged by the lower surface of the respective step slat 4 so that, as a consequence, the support rollers 12 will rotate. The support belt 13 will the move with the same speed as the movable surface 1. Since bolts 21 of the support roller 12 are fixedly located in the frame, there is practically no bowing or hanging-through of the belts 5 since downward vertical forces applied to the step slats 4 are accepted by the rollers 12. Thus, the surface is practically flat while being slightly springy and resembles that of a natural soft grass, or other soft-surface athletic track.

In opposition to the belt 5, the belt 13 is not stretched under high pull, stress or pressure and not looped about the rotatable elements 10. Belt 13 is looped about support rollers 12 at the end in a very loose or slack manner, which minimizes the power. Negative forces of pull or squeeze are also eliminated, since belt 5 is very thin and shows numerous small steel cords of approximately 0.5 mm thickness in the main bending area as a fortification. In any way, a toothed belt 5 shows much less friction compared to a chain. A thick belt as driving element 5 or even as movable surface causes far too much friction. This invention allows a runner to use the apparatus in a 5% elevation position without any external motor power.

Figure 6:
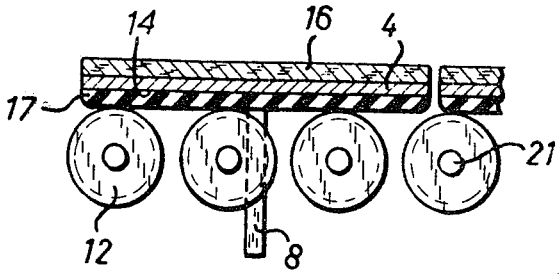
FIG. 6 is a fragmentary vertical sectional view similar to FIG. 5, but illustrating another embodiment of the invention.

FIG. 6 illustrates an embodiment of the invention in which very small support rollers 12 are used, located immediately adjacent each other, each supported on a respective bolt 21. The rollers in FIG. 6 are so dimensioned that, in any position of the slat 4, at least two rollers 12 on each side are in supporting engagement with the respective slat 4; as shown, the arrangement of three rollers 12 in engagement with each end of the slat 4 is preferred.

FIG. 6 also illustrates another embodiment of the inventive concept in that, rather than using a separate support belt 13, the lower surface 14 of the slat 4 has a yielding layer 17 secured thereto, for example made of rubber or other elastic material, in order to provide for elastic springy support of the respective slat 4 on the support roller. The arrangement between the support region of engagement of the layer 17 with the support rollers 12, 12' is shaped to provide lateral guidance, for example by being in channel form to define lateral guide ridges or surfaces. The embodiment of FIGS. 4, 5, 7, 8 and 11, in which a separate belt 13, 13' is used, is preferred; however, belts 13, 13', are subject to wear and, as has been found in use, need more frequent replacement than any other component of the equipment. Positioning a separate belt 13, 13' over the laterally freely supported rollers 12, 12', as best seen in FIGS. 4 and 7, for example, permits ready exchange of the belts 13, 13' upon wear thereof. Layer 17 is spaced from rollers 12 only in the initial zone.

The embodiment illustrated in FIG. 7, in which the belt is a V-belt 13', is particularly suitable; the support rollers 12' are grooved, or shaped to match the cross section of the V-belt 13'. The lower run of belt 13' can hang through—as shown schematically in FIG. 8 with respect to flat belt 13—although belt 13 is preferably placed under sufficient tension so that the hang-through is relatively small. Regardless of the type of belt, the center web 8 of the slats 4 is recessed to provide clearance space 37 (FIGS. 7, 8) between the end thereof and the surface bearing structure formed by support rollers 12, 12', respectively.

Lateral guidance of the belts 13 is important since, when the steps 4 are loaded and thus in engagement with the belts 13, lateral forces which invariably arise will be accepted thereby, thus permitting a construction which provides for longitudinal movement of the surface by a flexible belt 5 looped about the sprockets or toothed rollers 10 of such a construction that essentially noiseless operation is ensured. No heavy chains are needed, and the transport of the slats 4, themselves, can be accomplished by the belts 5 alone which are in engagement with the respective rollers, pulleys or sheaves 10 at the ends of the structure; the width of the running surface is thus not in engagement with the rotary elements at the ends of the structure, thereby avoiding sources of noise, particularly upon the change of the direction of the belt as it is looped about runs around the end rotary element. The physical or mechanical strength of the belts 5 can be matched to the longitudinal loading placed thereon; the vertical forces, which hold the slats together upon a load placed thereon due to the weight of the user, are accepted by the numerous rollers 12, 12'. The interposition of a soft or resilient element, such as the belts 13, 13' between the slats 4 and the rollers 12, 12', respectively, which suitably are made of steel, bronze, or the like, provides for a soft, yielding material between hard surfaces, thus additionally contributing to low-noise operation.

Preferably, the rollers 12 are small with respect to the width of the slats 4, as explained in connection with FIG. 6. The axes of rotation of the rollers 12, as determined by the shaft or bolt 21 (FIGS. 5, 6, 7), differ from the position of the axis of rotation of the rotary elements supporting the movable surface 1, which is indicated at 50, FIG. 3. It is also possible to mount the brackets 20 securing the shafts 21 (FIG. 7) inwardly—with respect to a center line of the apparatus—thus improving the accessibility of the belts 13, 13' for replacement, although this may require slightly larger rollers 12, 12' or foreshortening of the central web 8. Forming the terminal roller **12*a* (FIG. 12), of the group of rollers, as the turn-around point for the belt 13, 13', rather than guiding the belt 13 about the transverse shaft connecting the end rotary elements 10 permits replacement of the belts 13 without disassembly of the apparatus, and specifically of the surface 1**, other than possible removal of a housing dirt shield or side panel.

The path of the support belts 13, 13' need not be entirely flat and parallel to that of the surface 1. FIG. 12 illustrates, for example, that the terminal rollers **12*a* are positioned slightly lower than the remaining rollers 12, of which only a few are shown for illustration. The terminal or end rollers 12*a* may also be slightly larger than the other rollers 12 to provide for a greater turn-around radius which additionally decreases the noise level of operation, and the power requirements. FIG. 12** merely shows the general arrangement, all parts unnecessary to an understanding of the concept explained in connection therewith having been omitted for clarity. The structural elements and the remainder of the apparatus may be as described in connection with the preceding figures.

Figure 8:
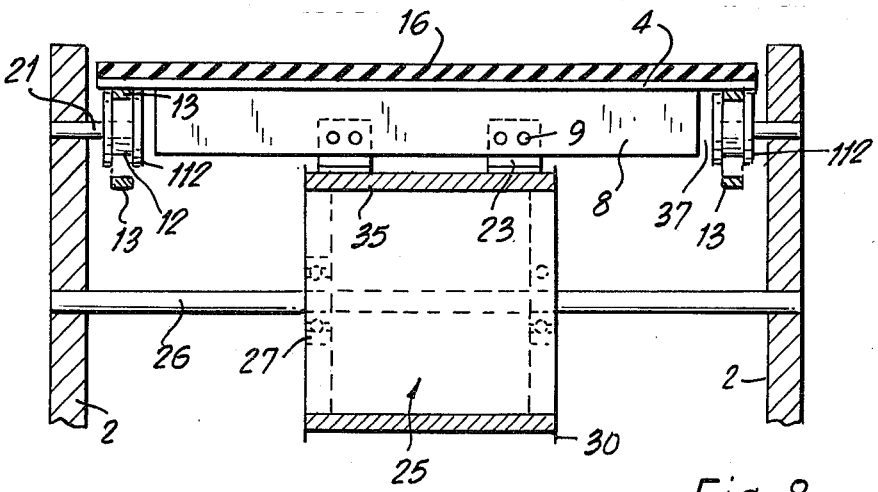
FIG. 8 is a cross sectional view illustrating another embodiment of the invention.
Figure 9:
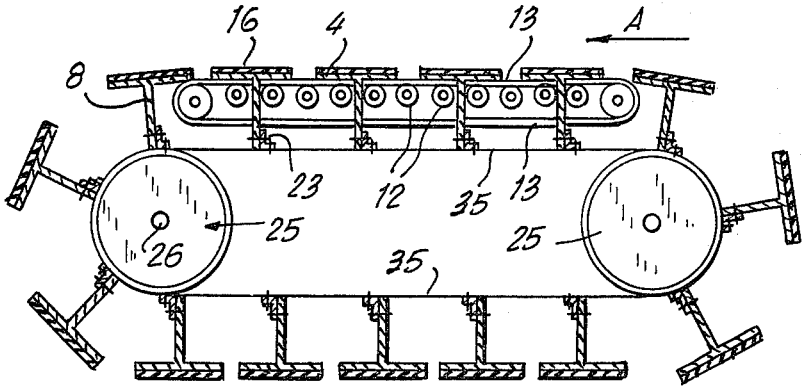
FIG. 9 is a highly schematic side view of the embodiment in accordance with FIG. 8.

Embodiment of FIGS. 8 and 9: Elements previously described have been given the same reference numerals and will not be described again.

Rather than using two lateral toothed belts 5, a central endless web 35 is used, looped about two end drums or rollers 25. Web or belt 35 preferably is made of rubber. This belt 35 is comparatively wide and has angle elements 23 secured thereto, for example by riveting, screw connection, or the like. The angle elements 23, in turn, are secured to the central webs 8 of the step slats 4. The connection point of the step slats on web 35 should be as far as possible so that the slats 4 are guided truly perpendicularly to their running direction, without skew. The center web 8 of the step slats 4 is foreshortened at the end in order to provide room for the support rollers 12, or 12', respectively, and for the support belt 13, 13', respectively. The flat bottom sides 14 of the step slats are engaged by support belts 13 upon loading thereof, similar to the arrangement described in connection with FIGS. 1–5 and 7. The only difference is the replacement of the toothed belt 5 and the end tongues 38 of the slats 4, which are not needed because the lower surface of slat 4 is spaced from driving belt 35 by the center web 8 and this prevents noise. The rollers 25 have laterally projecting rims 30 in order to guide the web or belt or toothed belt 35 and prevent its lateral excursion. The rollers 25 are journalled by ball bearings 27 on a central shaft 26 secured to the frame structure or, in the embodiment shown, to the side wall of the housing 2. The step slats 4 are slightly shorter than the distance between the side walls of the housing 2 to provide for slight lateral clearance. The width of the belt 35, however, is substantially less than the length of the slats 4, preferably $\frac{1}{3}$ as wide as the length of the slats.

The arrangement of the moving surface can be horizontal or slightly inclined. Use of rubbery or other similar elastic material provides for low-noise operation. A typical standard overall length for the apparatus is about 2 meters, with a width of about $\frac{3}{4}$ meter, and a height above ground level of the upper run of the moving surface of about $\frac{1}{4}$ meter. A distance counter, speedometer and elevation indicator can be included in the box for the control element C to indicate, for example the distance a user has run or walked while exercising on the device. The provision of a toothed, positive drive of the surface by the toothed belt 5, or the belt 35, which operate around their respective end rollers or drums without slip provides for accuracy in measuring the distance of travel of any one slat during its operation for ergometric analysis.

Embodiment of FIG. 10: The resilient, elastic cushion support 5 has been replaced by a belt 5' which has a toothed or ribbed section 7' similar to the ribbed belt 5 with teeth 7, and a smooth portion 36', against which support roller 12 can bear. The belt 5' thus, at the same time, forms the resilient cushion between the slats 4 and the support rollers 12, 12' respectively, as well as the longitudinal stiffening element which holds the slats 4 in adjacent alignment in the right position (right-angle position with respect to the running direction, at the ends respectively in the area of driving elements 10).

Rollers 12, 12', respectively, are carried on shafts 21 secured to a bracket 19 which is attached to the side wall 2 of the apparatus; a second arm 20' provides for lateral guidance of the bolt 21. The connections of the bracket elements to each other and to the side wall, or to the frame of the apparatus, may be by welding, for example.

The specific shape of the belt 5' can be suitably selected; for example, the belt 5' may be wedge-shaped in the region 36', similar to V-belt 13' (FIG. 7), with suitably modified rollers 12'. Alternatively, an additional belt similar to belt 13, or 13', respectively, may be placed beneath belt 5' (FIG. 10) to provide for double cushioning. FIG. 10 illustrates the belt 5' in engagement with roller 12, that is, the condition when the slat 4 is loaded, for example by the weight of a user symbolically indicated by weight arrow W. When unloaded, rollers 12 and belt 5' are partially spaced. FIG. **10*a* shows roller 12 supporting belt 5''. Lateral tooth or ribbed sections 7'', 7'', on either side of the roller 12 prevent lateral dislocation of slat 4. The bolts 21 which support the respective roller 12, 12' are directly secured to the frame 2. As seen in FIG. 10*a*, belt 5'' has the dual function of lateral guidance and cushioning support, that is, the additional function of belt 13**, which, then, can be omitted.

The end drums or rollers 10 (FIGS. 2, 3) preferably have a width which is just wide enough to engage the belt 5, or the region beneath the ribbed section 7' of the belt 5' of FIG. 10. Thus, and since their axes are below those of the bolts 21, they can be located to partly overlap the curvature of the terminal roller 12*a* (FIG. 12) without interference; the respective support member 32 (FIG. 7), 36 (FIG. 2) or 19 (FIG. 10) can be cantilevered for the support of the final or terminal roller 12*a*—or any other suitable construction well known in the mechanical field may be used. The detailed showing of such support rails has been omitted from FIG. 12 for clarity; the respective support member is seen in FIG. 3 in broken lines beneath the right-hand slats 4; the rollers 12, themselves, have been omitted from FIG. 3 for clarity. The frame arrangement with the position of the support members 19, 20 and 32 is clearly shown in FIG. 19, also the position of driving element 10 and support rollers 12, 12*a*. This FIG. 19 also shows the easy replacement of belt 13.

For some uses it may be desirable to form the surface 1 as a single unitary element, and not as a composite made of separate slats 4, secured together by a belt 5 (FIGS. 2–7), 35 (FIGS. 8, 9), 5' (FIG. 10). FIG. 11 shows a single belt 114, for example, made of elastic, yet sturdy, plastic or synthetic material which has alternatively a hard and a flexible connection and preferably a soft surface 116 applied thereto, similar to surface 16, FIGS. 5–10. The element 114 is formed, at least at one lateral side, with a ribbed or toothed portion 117, corresponding to the regions 7' in FIG. 10, destined for engagement by sprockets or toothed wheels or pulleys 10 (FIGS. 2, 3). This engagement process will also bring the belt 114 in a correct right-angle position with respect to the running direction by said portion 117. The element 114 has preferably a generally smooth lower surface 111, but not necessarily. The support belt 13, as described in connection with the embodiments of FIGS. 2–10, is supported on rollers 12, formed with lateral flanges 112 on either side, or on both sides, to provide for lateral guidance of the belt 13, and hence of the support surface 114 when weighted or loaded by the weight of the user. The support surface 114 is preferably formed with transverse ribs 118 which correspond to the ribs 8, FIGS. 4–10. The ribs 118 can be molded on the surface 114 so that the entire movable surface can be one unitary element. Roller 12 is indicated only in schematic form, with its axis of rotation shown also only schematically. The belt 13 may be flat, as shown, or may be a V-belt, in which case roller 12 would then be made in the shape of roller 12', FIG. 7. The roller 12 can also grip directly into element 114 and can be guided by grip elements 117 on one or both sides. Grip element 117 can also directly support on roller 12, guided by element 112 on one or both sides.

The apparatus can be modified to provide additional training capability, for example, for cross-country skiing. FIGS. 13–17 illustrate modifications of the surface. The basic surface 1 is shown in FIG. 13 only schematically, with the respective step slats 4 also shown only in schematic form. Belts or covering materials 133 are preferably applied at the lateral outside regions over the surface 1. Belts or covering materials 133 are made of a material which is tough and resistant against puncturing to accept, for example, the tips of cross-country ski poles; these tips themselves may be protected by a friction end cup to reduce the wear on the belts or covering materials 133. The belts or covering materials 133 have a track section 132 located adjacent thereto; track section 132, preferably, has a slippery material which is placed, sectionally or in endless form, directly over the slats 4 or their covering 16, 116, to provide a guide track for cross-country skis, for example. Since the tracks for cross-country skiing are not closely adjacent, an intermediate spacer section 134, which may be similar to the sections 133, but preferably narrower, is interposed, as best seen in FIG. 13.

The tracks 132 can be applied in various ways. FIG. 13 shows the segmental surface zones formed by belts or covering materials 133, at either side, and by belt or covering materials 134. These belts or covering materials, rather than being of tough material, may also be made of extremely soft material to permit engagement and penetration of ski pole tips, for example, foam material, whereas the track zones 132 have a slippery surface, for example, a coating of Teflon or brush of Teflon. In case that the belt 133 or covering materials 133 are made of stiff or hard materials—very hard material is sectionalized—the pole tips of the ski may also have a piece of rubber, this specially, when the pole tips grip directly on the step slats 4. Sectionalized means working surface arrangement like the step slat arrangement. The entire arrangement may be constructed in the form of different belts or covering materials-zones, placed adjacent to each other; or of one unitary belt 141, which might be also sectionalized, shown in FIG. 14, with lateral sections 143 and ski track sections 144 which have a coating 145 applied thereto to form a slippery sliding surface for skis. The section 143 can be made by the step slats 4, also section 144, preferably covered by materials. If the user wishes to quickly change the surface from cross-country ski training to running training, additional elements 155 may be provided, in the form of elongated strips of a material having approximately the same resiliency to compression as the material of the sections 143 of FIG. 14. These strips 155, preferably in the form of loops or sectionalized elements, can then be placed around the running surface, engaged in the grooves 144 (FIG. 14) for the skis, so that the entire surface will become level. Preferably, the surface consistency of the belt 141 is comparatively soft, to accept the tips of ski poles, which additionally provides for a soft tread as a running surface.

FIG. 16 illustrates an arrangement in which track guidance strips or elements which, in cross-section, appear in sectionalized or uniform or unitary or connected block form, are placed over the surface 161 which, of course, corresponds to the surface 1 (FIGS 1–10; 13). These strips or elements 165 are to be removed when the apparatus is used as a training element for running. The portion of the surface between the strips or elements 165 is slippery. Preferably, the strips or elements 165 are raised strips placed on a slippery carrier 166, which may extend across the entire width of the surface 161 as a skating surface. Another tracking arrangement is shown in FIG. 17 in which longitudinal strips or elements 175, with a slippery running surface 176 therebetween, are made of flexible material in the form of an endless loop, are placed around the running surface 171 which, as before, corresponds to the surface 1, with slats 4 (FIGS. 1–12). This permits a reduction of the additional material needed since only two continueous endless or sectionalized attachment strips 175 with the slippery central or track zone 176 are needed. The attachment permits training not only for cross-country skiing but also for downhill skiing; for example, by substantially inclining the apparatus and restraining the user, for example by a rope looped about his hips, the sensation of movement with respect to ground surface can be simulated. The lateral guidance of the surface 1, by means of the flanges 112 or tongues 38, ribs 117, and/or the V-belts 5' with the V-pulleys 12', is particularly important if the apparatus is so modified.

The separation of the tracks 132 from each other by the intermediate zone 134 is approximately the width of the hip of the user, that is, the customary tracking width for cross-country skiing. The surface characteristics of the lateral zones 133 is governed, essentially, by the wear placed thereon and the desires of the user; the surface of the track sections 132 should, however, be essentially slippery on the bottom and on the sides and promote easy gliding.

The rollers, pulleys, wheels or sheaves which support and guide the surface 1 are located, essentially, in the corners of the apparatus which, in top view, is generally elongated and rectangular (FIG. 19). Engagement of these rollers or pulleys or sheaves with the movable surface preferably is at the extreme lateral sides so that the closed or sectionalized loop formed thereby will run true, permitting it to automatically re-adjust itself for longitudinal running after being changed in direction by 180°, upon passage about the end wheels, drums, or rollers. Use of separate support belts 13, 13' which take over simultaneously support, damping and lateral guidance in combination with their rollers 12, 12' is the preferred form, particularly when arranged so that the rollers are supported at the ends of stub shafts 21, or the like, permitting rapid and easy removal and replacement of the belts 13, 13'.

The connections of the respective step slats to each other need not be by means of the lateral drive belts 5; the slats can be connected together also by interengaging projection-and-hook arrangements, or by movable rib-and-slot connections, the inwardly directed projections or teeth for engagement with depressions on the wheels, sprockets or sheaves 10 being molded or formed directly on the respective slats, similar to the teeth 117 (FIG. 11). FIG. 18, schematically, illustrates one such connection in which a slat 4' is formed with a projecting rib 181 which terminates in an enlarged bead at one side thereof, and, at the other side of the slat—FIG. 18 illustrating an adjacent one—a groove 182 is formed, with a circular recess into which the bead of projection 181 can be slipped. FIG. 19 shows, highly schematically, a top view of the arrangement of the end pulleys 10 in the form of sprockets located on the frame 2, shown only schematically, which has frame members 32 supporting rails 20 which, in turn, support V-rollers 12' and adjacent rollers 12. Not all the rollers which support the belts 13, 13' need be V-rollers. Flat support rollers, which are less expensive, can be used mixed in with flanged or V-rollers, as shown in FIG. 19. From the upper run, a showing of the belt 13 or 13' has been omitted. In the lower run—with respect to FIG. 19—the belt 13 is shown in broken lines. The representation is highly schematic, with the running surface 1, including its slats or equivalent surfaces omitted. Either one, or both of the wheels 10 at the right side can be driven by the motor 34, or the shaft 26 connecting the wheels 10 can be in external driving engagement with a suitable arrangement to provide drive thereto, as schematically indicated by the rotation arrow n.

FIG. 20 shows an arrangement in which the lateral guidance, as well as vertical support, is effected by stationary elements. The individual step slats 204 are formed of plastic material; preferably consisting in a hard and flexible portion they have, preferably as an integral molding, transverse webs 208 molded thereon, and projecting teeth 205 at the outer sides. The teeth 205 engage into the spaces between ribs or teeth of the end rollers 10 (see FIG. 19, for example). The ribs 205 also form part of the integral step molding. The step molding is, further, formed preferably with two internal projections 202, which leave a space or channel therebetween, for engagement between the projections of an upstanding element 203, formed as a longitudinal rail and having, preferably, the shape of the upper run of the belt 13 of FIG. 12, that is, is flattened downwardly adjacent the end portions. The rail 203, engaging between the projections 202, has an upper low-friction surface thereon, for example a layer of Teflon ® 206. The portion of the step slat between the projections 202, and alongside, may also be coated with, or have a low-friction surface applied thereto. The low-friction surface 206 preferably extends laterally along the sides of the rail 203. The rail 203 is supported by brackets 201 which may have any suitable shape and, for example, are welded to suitable support or frame members of the frame 2, possibly with interposition of another longitudinal rail or bracket. In normal operation, the step slat 204 will be placed over the projection 206 in such a manner that the projections 202 engage therearound, leaving preferably, however, some clearance between the top surface 206 and the under-surface of the upper run of the continuous movable surface of which the step slats 204 are a part, until the surface is loaded. When the surface is loaded, vertical weight forces are accepted by the rail 203, as supported by brackets 201. Lateral forces are likewise accepted by the rail 203. Low-friction engagement is ensured by the low-friction surface 206 and, if present, similar low-friction surfaces on the respective step slats.

The arrangement can be reversed; for example, rather than forming a U-channel on the step slats 204, the step slats can be formed with only one projection 202, and the rail 203 formed as a U-channel surrounding that one projection. The projection—whereever formed, and a U-channel—wherever formed—thus provide an interengaging projection-and-recess guiding arrangement which, simultaneously, provides for vertical support as well as accepting lateral forces which arise when a user runs, or otherwise uses the upper surface.

The step slats can be connected in various ways. FIG. 21 illustrates an arrangement in which a plurality of adjacently located step slats 214 are formed with inner webs 218, and at the outside with ribs 215 to engage the toothed or ribbed rollers 10, located at the corners of the frame. To provide for vertical support and guidance, a cable or rope 213 is, similarly to belt 13 as shown in FIG. 12, placed on rollers 212. Preferably, the slat 214 is formed with a guide groove 219, which can be defined by small projecting beads, or cut into the slats 214 themselves to additionally ensure longitudinal guidance. The rope or cable 213 preferably is made of a material which is resiliently compressible and additionally has a high friction outer surface so that lateral forces arising upon loading of the step slats 214 will be transferred directly to the rollers 212. Rollers 212 can be supported from the frame of the apparatus in any suitable manner, for example similar to rollers 12, 12', as previously described. Adjacent slats are connected by a cable 217.

The step slats can be connected not only by a continuous arrangement with a hard and flexible section, but also by separate connecting elements. FIG. 22 shows two adjacent step slats 224 in transverse section, each of which is formed at its end portions with a groove which provides an internal enlargement 222. A coupling element 221, with projecting beads 226, fits into the internal enlargements 222 to couple the slats 224 together so that the assembly of the step slats will form an endless, articulated, continuously movable surface which can be looped about the rollers 10 at the ends of the frame. The projection 225 on the coupling element 221 projects from the lower or inner surface of this endless loop formed by the surface assembly, for engagement into the spaces between teeth or ribs or lands of the rollers secured to the frame, to provide for positive and synchronous drive of all four rollers. The rollers 10 engaging the coupling elements or the ribs of the belts associated with any one step slat preferably are coupled together, so that, effectively, the rollers at the respective sides at any one end are synchronized. This additionally ensures true running of the endless surface. The top covering 16 has been omitted from the showing of FIG. 22. All other elements of the apparatus may be similar to previously described embodiments.

FIG. 23 illustrates connecting elements 221, which joins slats 224 together. Connecting elements 221 secure the slats together by chemical attachment, for example by being molded together, or welded together.

The motor 33 and the drive belt 34 (FIGS. 2, 3) are not strictly necessary. The entire arrangement has such low friction—resulting in very low noise level—and can be made of such low weight that even a slight inclination of the upper run of the support surface with respect to level ground permits use of the apparatus as a self-walking surface without requiring a user to exert a substantial push in his walking effort. Although the balance of forces is unaffected by the inclination of the running surface, the comfort of the user is enhanced thereby and a slight upward inclination is preferred when the system is to operate, for example as a physical training exercise for athletes, under the muscle forces provided by the user. Since these muscle forces however also apply substantial lateral forces on the surface, a positive lateral guidance, for example by use of V-belts (FIG. 7) is preferred.

Various changes and modifications may be made, and features described in connection with any one of the embodiments may be used with any of the others, within the scope of the inventive concept.

I claim:

1. Movable surface apparatus for physical exercise and training comprising:

an essentially rectangular support frame (2);

two rotatable end roller means (10; 25) having parallel axes of rotation supported on said frame (2), located adjacent the narrow sides of the frame, at least one of the end roller means having a toothed or ribbed circumference;

two endless toothed or ribbed connecting belt means (5, 5') looped about said toothed or ribbed end roller means (10, 25) and located laterally spaced adjacent the lateral sides, and in alignment with said rollers;

the end roller means having a diameter large with respect to the thickness of the toothed or ribbed connecting belt means, the ribs on the connecting belt means being in engagement with the gaps between the ribs or teeth on the surfaces of the end roller means and, in the course of travel about the end roller means, being aligned and oriented perpendicularly to the axes of rotation of said end roller means;

a plurality of closely adjacent transversely positioned step elements (4, 4', 114) secured to the toothed or ribbed connecting belt means, and forming with said connecting belt means an endless continuous movable, essentially even surface assembly looped about said rotatable end roller means to form an upper run and a lower run;

a plurality of support rollers (12, 12') located beneath the upper run with their axes of rotation parallel to each other and to the axes of rotation of the toothed or ribbed end roller means (10, 25), said plurality of support rollers being located in at least two lines adjacent the lateral sides of the frame and secured thereto, the axes of rotation of said support rollers being independent of the axes of rotation of the toothed or ribbed end roller means, said support rollers having a diameter which is small with respect to that of the toothed or ribbed end roller means, and at least one lateral end face of at least some of the support rollers in each line being formed with a radially projecting flange (112);

and at least two resilient, endless belts (13) looped about the terminal support rollers (12*a*) of said lines of the plurality of support rollers (12, 12', 12*a*) and located between said rollers and the underside (14) of the upper run of said support surface to support the step elements throughout their travel lengthwise of the frame, and hence of the apparatus, upon rotation of at least one of said end roller means and provide a yielding, resilient, independently movable cushion support between the step elements and the support rollers.

2. Apparatus according to claim 1, wherein the endless toothed or ribbed connecting belt means (5, 5') are located adjacent the resilient endless support belts (13).

3. Apparatus according to claim 2, wherein the upper surface of the upper run of said resilient endless support belts is slightly spaced from the lower surface (14) of the upper run of the support surface in the area, where belts (13) are looped about the end-rollers (12), when unloaded.

4. Apparatus according to claim 1, wherein the endless toothed or ribbed connecting belt means (5, 5') are located closely adjacent the lateral sides of said movable surface and outwardly adjacent—with respect to the center line of the apparatus—to the resilient endless support belts.

5. Apparatus according to claim 1, wherein the resilient endless support belts (13') are V-belts;

and at least some of the plurality of support rollers (12, 12', 12*a*) are V-grooved rollers in vertical, weight-supporting and lateral, direction-maintaining engagement with the lower and lateral sides of said V-belts.

6. Apparatus according to claim 1, wherein said two resilient endless support belts (13) are flat belts; and at least some of said plurality of support rollers (12, 12*a*) are formed with said lateral flanges (112), and are dimensioned to engage the lateral sides of the support belts at opposite sides—with respect to the center line of the apparatus—to provide for vertical load support of said endless support belts and lateral directional guidance of said support belts, and hence of said movable surface when the movable surface and the support belts are pressed on the rollers due to the weight of the user on the movable surface.

7. Apparatus according to claim 1, wherein the step elements (4, 4', 114) have a central web (8) extending transversely of the apparatus and projecting inwardly, with respect to the loop formed by the movable surface, the web (8) extending up to and just short of the lateral side regions in alignment with said plurality of rollers (12, 12', 12*a*) to provide a stiffening web for the central portion of the movable surface adjacent the region where the upper run of the movable surface is supported by said rollers.

8. Apparatus according to claim 1, wherein the step elements (4, 4') comprise discrete step slats;

and wherein the support rollers (12, 12') have a diameter and mutual spacing with respect to the width of the step slats to provide engagement of at least two support rollers with any one step slat at each side—with the resilient, endless support belts (13) interposed—with any step slat at each side during movement of each step slat.

9. Apparatus according to claim 1, further comprising a soft, sock-absorbing top layer (16) on the step elements (4, 4', 114), said soft layer comprising a yieldable surface including at least one of the materials of the group consisting of: cork; dense foam rubber; sponge rubber; artificial lawn surfacing; indoor/outdoor carpeting without or with sponge or foam material backing; plastic foam material, natural or synthetic rubber, synthetic materials, carpet.

10. Apparatus according to claim 1, wherein (FIGS. 3, 4) the step elements (4) comprise a plurality of closely adjacent step slats having projecting tongues (38) at their lateral ends;

said endless toothed or ribbed connecting belt means comprising two endless, toothed connecting belts (5), one each located at a lateral side of the frame, said projecting tongues (38) being secured to said endless toothed or ribbed connecting belts;

and wherein the width (B) of the tongues (38) is substantially less than the width of the step slats to permit ready passage of said step slats around the rotatable end roller means (10) without noise and without slap of the slats against the connecting belts (5) as the slats are leaving the circumference of the end roller means and start upon the upper or lower run, respectively.

11. Apparatus according to claim 10, further comprising a central web (8) secured to the underside of the respective slats (4) to stiffen said slats against bowing transversely of the support surface, said web terminating inwardly of a line forming a projection of the resilient endless support belts (13).

12. Apparatus according to claim 10, further comprising attachment means (9) passing through the tongues (38) of the step slats and the toothed or ribbed connecting belts (5), the attachment means being located in the region of the teeth (7) of said toothed belts to prevent engagement of the attachment means (9) with the ribs or teeth of the end roller means, and thus provide for low-noise passage of said movable surface thereabout.

13. Apparatus according to claim 1, wherein a plurality of support rollers (12) are provided, the rollers (12*a*) at the respective ends of the line of support rollers, and about which the resilient endless support belts (13) are looped, are located with respect to the bottom surface of the movable surface (1) to provide for clearance when the movable support surface is unloaded;

and the terminal rollers (12*a*) of the plurality of rollers have their axes of rotation positioned below the remaining rollers of the plurality of rollers, and adjacent the circumference of the end rollers means (10) to provide for gradual engagement of the bottom surface of said movable surface (1) with the top surface of the resilient endless support belts (13, 13').

14. Apparatus according to claim 1, wherein the end roller means (10), each, comprise a pair of toothed or sprocket or gear-shaped wheels (10), one each located at a respective corner of the essentially rectangular frame, and wherein wheels at the same lateral sides of the rectangular frame are in engagement with a respective endless toothed or ribbed connecting belt means being looped around said wheels.

15. Apparatus according to claim 1, further including a motor means (33) driving at least one of said end roller means.

16. Apparatus according to claim 1, wherein (FIG. 18) said step elements comprise step slate (4') formed with interlocking projection-and-recess means (181, 182) to lock said individual step slats (4') together while permitting individual movement thereof around the circumference of said toothed or ribbed end roller means and provide yielding support for the weight of a user as a user steps on one, or a plurality of adjacent individual slats.

17. Apparatus according to claim 1, further comprising a top surface cover (132, 133, 134) positioned over said movable surface (1) and comprising grooved sections (132) having a slippery or sliding surface to simulate snow cover against the bottom of skis; and lateral surfaces (133) complementary to ski pole tips.

18. Apparatus according to claim 17, further comprising (FIG. 15) insert strips (155) fitting into the grooves of said grooved section (132) to form, together with said lateral surfaces (133), a surface of uniform height.

19. Apparatus according to claim 17, wherein the slippery or sliding surface comprises a cover formed of low-friction material including at least one of the materials of the group consisting of: Teflon; brush material; fiber material; plastic; man-made fabric.

20. Apparatus according to claim 1, further comprising (FIGS. 16, 17) a top cover (166) of material having a low-friction upper surface to simulate snow or ice positioned over said movable surface in engagement therewith and moving therewith.

21. Apparatus according to claim 20, further including projecting guide element means (165; 175) on said top cover forming longitudinal guide tracks to simulate ski tracks depressed from a snow surface.

22. Apparatus according to claim 1, wherein the frame (2) includes longitudinal support rails located adjacent the respective sides thereof;

and the rollers (12, 12') of said plurality of rollers are secured to said support rails with stub shafts (21) projecting therefrom to leave an end face of the rollers exposed and permit ready removal and replacement of the resilient support belts (13, 13').

* * * * *